US009849567B2

(12) United States Patent
Ronshaugen et al.

(10) Patent No.: US 9,849,567 B2
(45) Date of Patent: Dec. 26, 2017

(54) LAPPING ASSEMBLY OR PROCESS UTILIZING A BAR STACK EXTENDER

(71) Applicant: Seagate Technology LLC, Cupertino, CA (US)

(72) Inventors: Marc Ronshaugen, Eden Prairie, MN (US); Joel Hoehn, Hudson, WI (US); Gordon Jones, Faribault, MN (US)

(73) Assignee: Seagate Technology LLC, Cupertino, CA (US)

( * ) Notice: Subject to any disclaimer, the term of this patent is extended or adjusted under 35 U.S.C. 154(b) by 867 days.

(21) Appl. No.: 14/071,905

(22) Filed: Nov. 5, 2013

(65) Prior Publication Data

US 2015/0123335 A1 May 7, 2015

(51) Int. Cl.

| | |
|---|---|
| ***B25B 1/24*** | (2006.01) |
| ***B25B 5/08*** | (2006.01) |
| ***B25B 1/08*** | (2006.01) |
| ***B24B 37/34*** | (2012.01) |

(52) U.S. Cl.

CPC ..... *B25B 5/08* (2013.01); *B24B 37/345* (2013.01); *B25B 1/08* (2013.01)

(58) Field of Classification Search

CPC ..... B25B 5/08; B25B 1/08; B24B 37/345
See application file for complete search history.

(56) References Cited

U.S. PATENT DOCUMENTS

| | | | | |
|---|---|---|---|---|
| 5,749,769 | A | 5/1998 | Church et al. | |
| 6,315,636 | B1 | 11/2001 | Yanagida et al. | |
| 6,346,029 | B1 | 2/2002 | Church et al. | |
| 6,374,479 | B1 * | 4/2002 | Sasaki | G11B 5/10 29/412 |
| 9,126,312 | B2 * | 9/2015 | Tseng | B23Q 3/104 |
| 2003/0199228 | A1 | 10/2003 | Kennedy et al. | |
| 2012/0018093 | A1 | 1/2012 | Zuniga et al. | |

* cited by examiner

*Primary Examiner* — Monica Carter
*Assistant Examiner* — Nirvana Deonauth
(74) *Attorney, Agent, or Firm* — Westman, Champlin & Koehler, P.A.

(57) ABSTRACT

A slider bar extender to removably connect one or more slider bars to a processing machine or tool is disclosed. In illustrated embodiments, the extender is coupled to a holder structure through a tongue and groove connection. In illustrated embodiments, the tongue is formed on the holder structure and the groove is formed on the extender. In illustrated embodiments, the extender includes a plurality of reduced thickness strips. The reduced thickness strips are orientated lengthwise to control or transfer bending to one or more bars connected to a proximal edge surface of the extender.

10 Claims, 13 Drawing Sheets

LAPPING ASSEMBLY OR PROCESS UTILIZING A BAR STACK EXTENDER

SUMMARY

The present application discloses embodiments of a slider bar extender to removably connect one or more slider bars to a processing machine or tool. In illustrated embodiments, the extender is coupled to a holder structure through a tongue and groove connection. In illustrated embodiments, the tongue of the tongue and groove connection is formed on the holder structure and the groove is formed on the extender. In illustrated embodiments, the extender includes a plurality of reduced thickness strips. The reduced thickness strips are orientated lengthwise to control or transfer bending to one or more slider bars connected to the bar extender. Other features and benefits that characterize embodiments of the present invention will be apparent upon reading the following detailed description and review of the associated drawings.

BRIEF DESCRIPTION OF THE DRAWINGS

FIG. 10A is a perspective view, FIG. 10B is a front view and FIG. 10C is an end view.

FIG. 11A is a perspective view, FIG. 11B is a front view and FIG. 11C is an end view.

DETAILED DESCRIPTION OF ILLUSTRATIVE EMBODIMENTS

Figure 1:
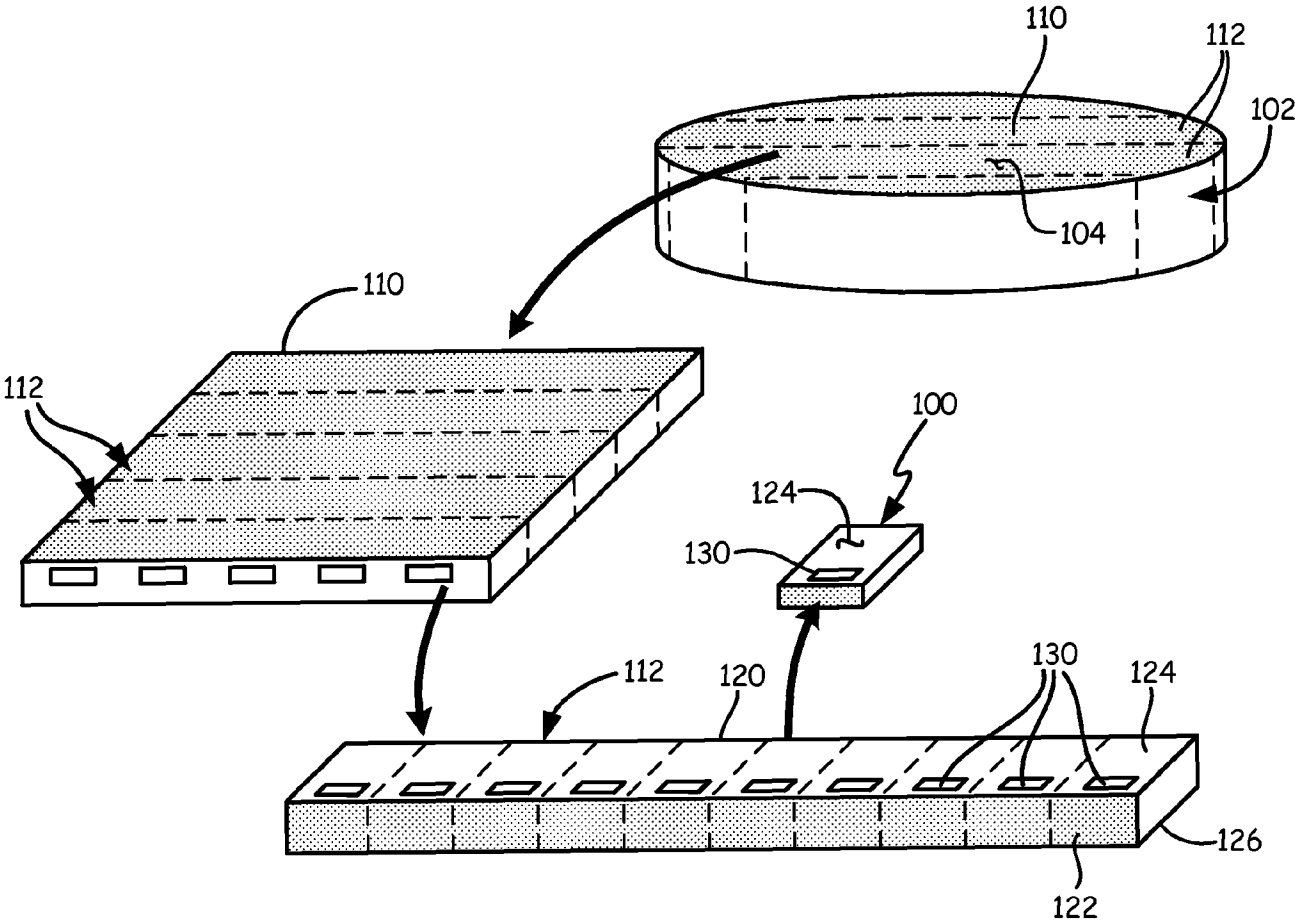
FIG. 1 illustrates a slider bar stack, slider bar and head fabricated from a wafer using thin film deposition techniques.

The present application discloses a workpiece extender for holding a bar stack for grinding, lapping and slicing steps for fabricating heads for data storage devices. As shown in FIG. 1, heads 100 are fabricated on a wafer 102 using thin film deposition techniques to deposit one or more transducer elements on a front surface 104 of the wafer 102. The wafer 102 is sliced to form a bar stack 110 having a plurality of slider bars 112. The bar stack 110 includes multiple or any number of slider bars 112. Bars 112 are sliced from the bar stack 110 and the heads 100 are sliced from the bars 112 as progressively shown. The slider bars 112 include a leading edge 120, a trailing edge 122, an air bearing surface 124 and a back surface 126. As shown, the deposited thin film layers form one or more transducer elements 130 along the air bearing surface 124 of the slider bar 112. During the fabrication process, bars 112 are subjected to grinding and lapping steps to control dimensional parameters and bow of the bars 112 utilizing various processing machines or tools.

Figure 2A:
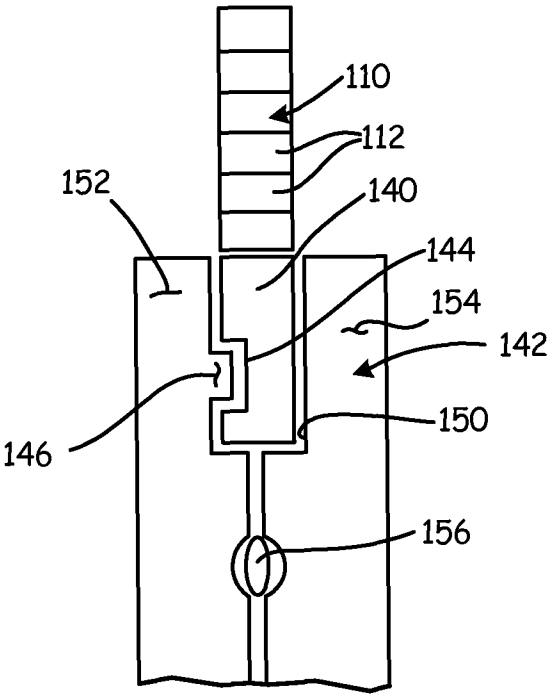
FIGS. 2A-2C illustrate a slider bar extender and tongue and groove connection to connect the bar extender and one or more slider bars to a holder structure of a processing machine or tool.
Figure 2B:
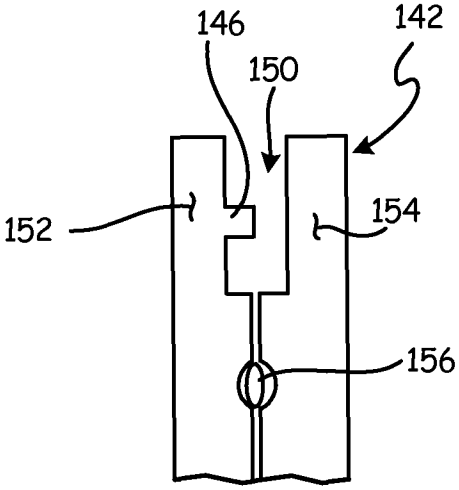
Figure 2C:
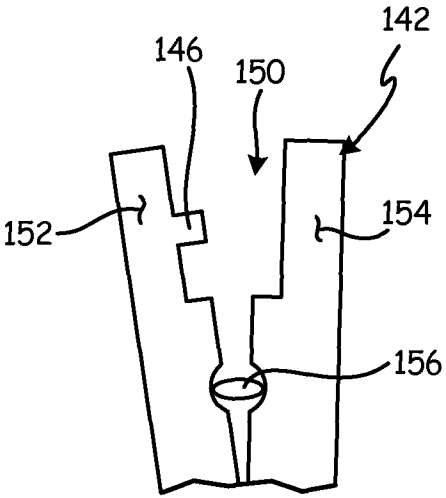

The bar stack 110 is connected to a processing machine or tool to fabricate the heads 100 through an extender 140 shown in FIG. 2A. The extender 140 connects to a holder structure 142 of the processing machine or tool. As shown in FIG. 2A, the extender 140 is connected to the holder structure 142 of the processing machine or tool through a tongue and groove connection. In the illustrated embodiment shown in FIGS. 2A-2C, the tongue and groove connection includes a groove 144 formed on the extender 140 (as shown in FIG. 2A) and a tongue 146 formed on the holder structure 142. In the embodiment shown, the tongue 146 is formed in an extender slot 150 between upright holder portions 152, 154 of the holder structure 142. As shown in FIGS. 2B-2C, the tongue 146 is formed on the upright holder portion 152 and protrudes into the slot 150 between the upright holder portions 152, 154.

As shown, the upright holder portions 152, 154 of the holder structure 142 are separated as shown in FIG. 2C to open slot 150 to insert the extender 140 into the slot 150. The upright holder portions 152, 154 are separated via application of a camming force through a camming device 156 as comparatively shown in FIGS. 2B-2C. After the extender 140 is inserted into the slot 150, the camming force is released to close the upright holder portions 152, 154 so that tongue 146 inserts into groove 144 to grip the extender 140 between the upright holder portions 152, 154 to secure the slider bar stack 110 to the holder structure 142 of the processing machine or tool.

Figure 3C:
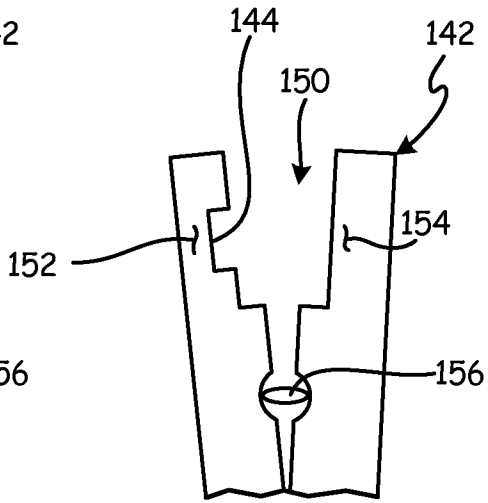
FIGS. 3A-3C illustrate an alternate embodiment of the tongue and groove connection for connecting the extender and the one or more slider bars to the holder structure of the processing machine or tool.
Figure 3B:
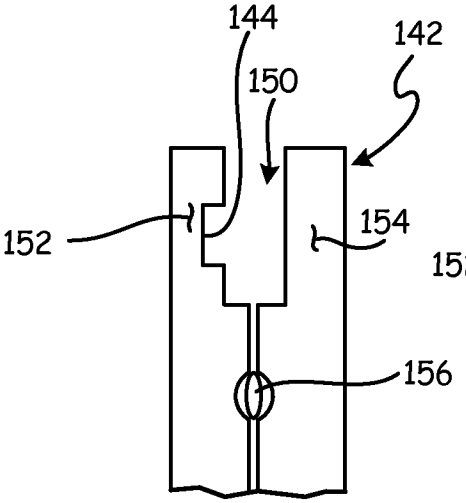
Figure 3A:
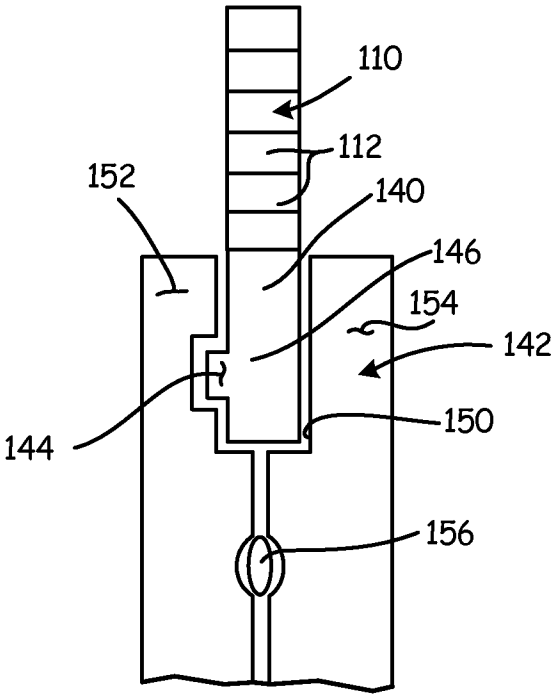

As illustrated in FIGS. 2A-2B, in a closed position, a camming lobe of the camming device 156 is orientated lengthwise. As shown in FIG. 2C, the camming lobe of the camming device 156 is orientated crosswise to separate or opened the upright holder portions 152, 154 to connect the bar stack 110 to the holder structure 142 of the processing machine or tool. The dimension of the lobe is wide enough to separate the upright holder portions 152, 154 to slide the extender 140 into the slot 150 and engaged the tongue and groove connection. FIGS. 3A-3C illustrate an alternate embodiment of holder structure 142 and tongue and groove connection where the tongue 146 is on the extender 140 and the groove 144 is formed on the upright holder portion 152.

Figure 4C:
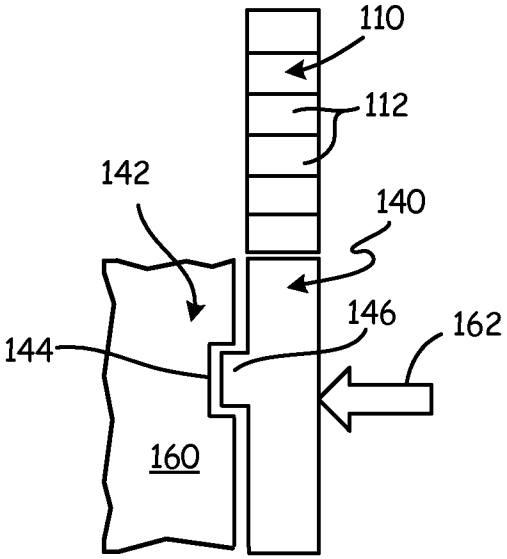
FIGS. 4A-4C illustrate embodiments of a tongue and groove connection and clamping mechanism to secure the bar extender to a holder structure.
Figure 4B:
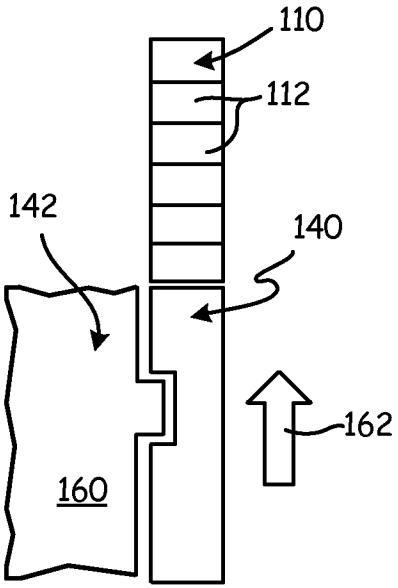
Figure 4A:
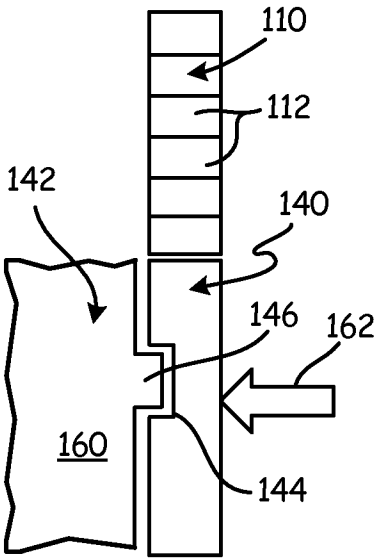

FIGS. 4A-4B illustrate an embodiment of the holder structure 142 including holder portion 160 and clamping device 162 (schematically shown). As shown in FIG. 4A, the holder portion 160 includes tongue 146 on a backside of the holder portion 160 to interface with the groove 144 on the extender 140. As shown, the clamping mechanism 162 operates between a clamped position shown in FIG. 4A and an open position shown in FIG. 4B. In the clamped position shown in FIG. 4A, the clamping device 162 biases the extender 140 against the holder portion 160 to maintain the tongue 146 in groove 144 to hold the slider bar stack 110 to the processing machine or tool. In the open position, the clamping mechanism 162 is disengaged from the extender 140 to remove the extender 140 and bar stack 110 from the processing machine or tool. In an alternate embodiment shown in FIG. 4C, the tongue 146 is formed on the extender 140 and the groove 144 is on the holder portion 160 to secure the bar stack 110 to the holder structure 142 for processing.

Figure 5A:
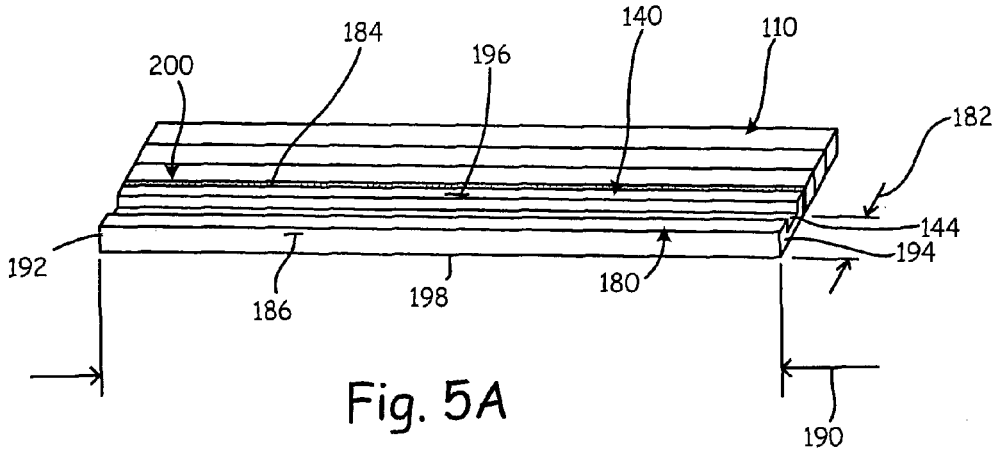
FIGS. 5A-5B illustrate an embodiment of a bar extender including the groove of the tongue and groove connection.
Figure 5B:
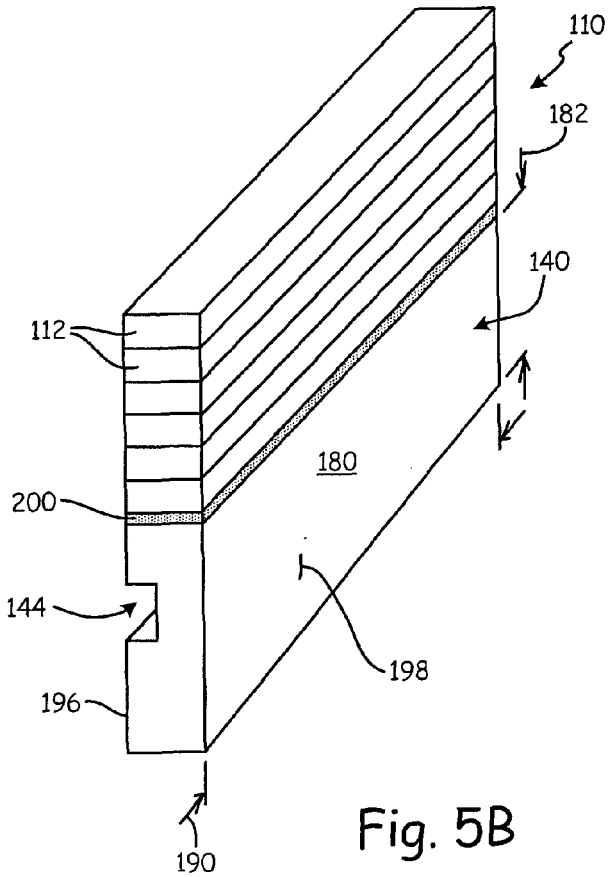

FIGS. 5A-5B illustrate an embodiment of the extender 140 having the groove 144 of the tongue and groove connection. As shown the extender 140 is formed of an extender body 180 having a lengthwise dimension 182 between a proximal edge surface 184 and a distal edge surface 186. The body 180 also includes and a crosswidth 190 extending between opposed end surfaces 192, 194. The extender 140 includes a thickness between a front surface 196 and a back surface 198. As shown, groove 144 is formed along the front surface 196 of the extender 140 and extends along the crosswidth 190 of the extender between the opposed end surfaces 192, 194. The groove 144 forms a recessed surface spaced from the front surface 196 between upper and lower edges of the groove 144. The ends of the groove 144 are opened at the opposed end surfaces 192, 194 of the extender body 180. As shown, the bar stack 110 is attached to the proximal edge surface 184 of the extender 140 through an adhesive layer 200 connecting the bar stack 110 to the top surface 184 of the extender 140.

Figure 6A:
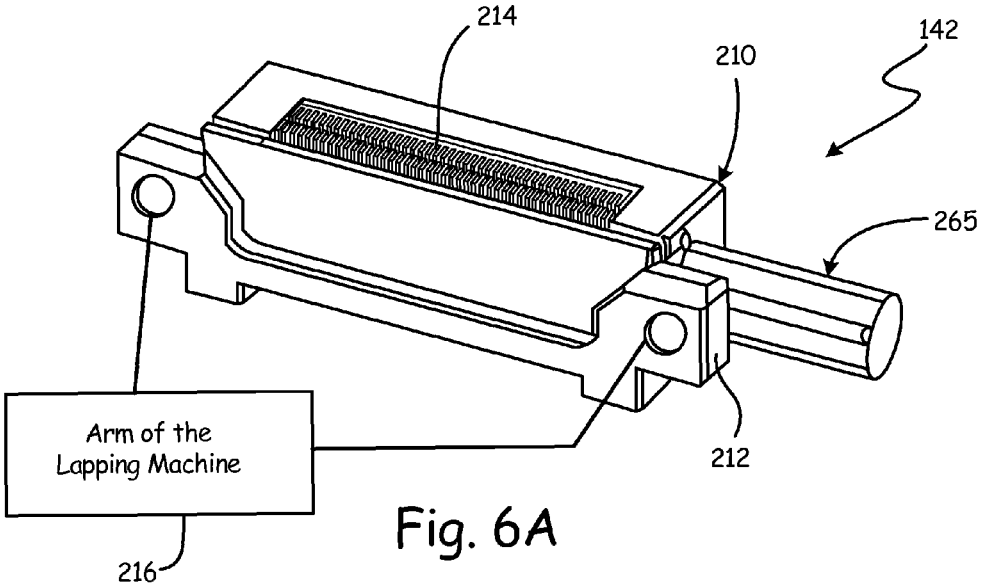
FIGS. 6A-6B illustrate an embodiment of a modular lapping carrier holder structure for a bar extender utilizing a tongue and groove connection.
Figure 6B:
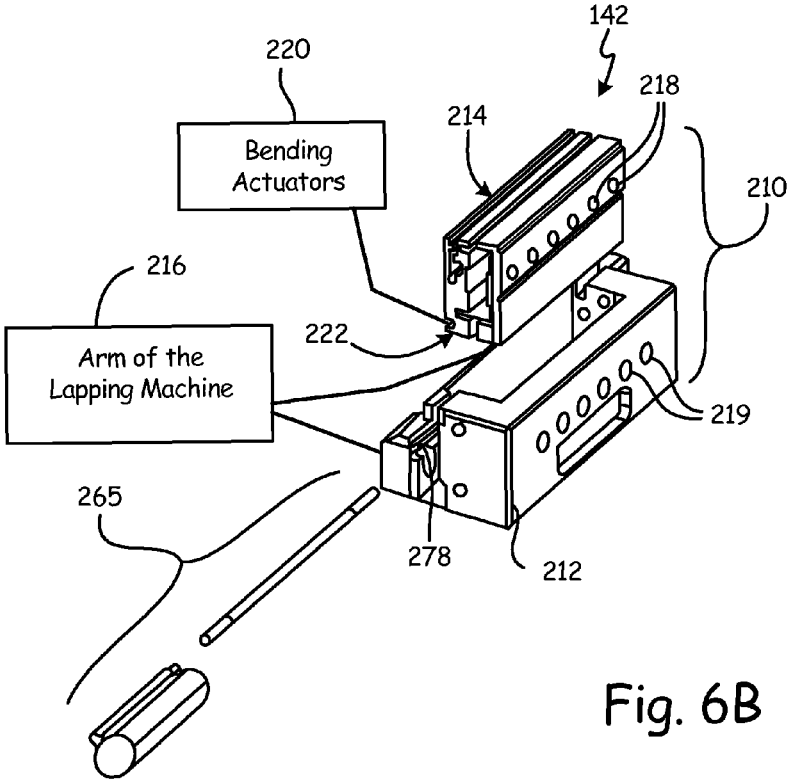

FIGS. 6A-6B illustrate an embodiment of a holder structure 142 for the bar stack 110 for a lapping machine including one or more bending actuators to adjust bending or bow to the bar 112 or bar stack 110 (not shown in FIGS. 6A-6B) through the extender 140. As shown, the holder structure 142 is a modular carrier device 210 including a carrier base 212 and a bending insert 214. The bending insert 214 is supported in the carrier base 212 and forms a bending portion of the holder structure 142. FIG. 6B illustrates the bending insert 214 exploded from the carrier base 212. The carrier base 212 is coupled to an arm of the lapping machine 216 (schematically shown). The arm of the lapping machine 216 is biased towards an abrasive lapping surface (not shown) to support the modular carrier device 210 and bar stack 110 (not shown in FIGS. 6A-6B) against the abrasive lapping surface. The bending insert 214 is connected to the carrier body 212 through one or more pins or fasteners (not shown) extending through openings 218, 219 in the bending insert 214 and carrier base 212.

Figure 7A:
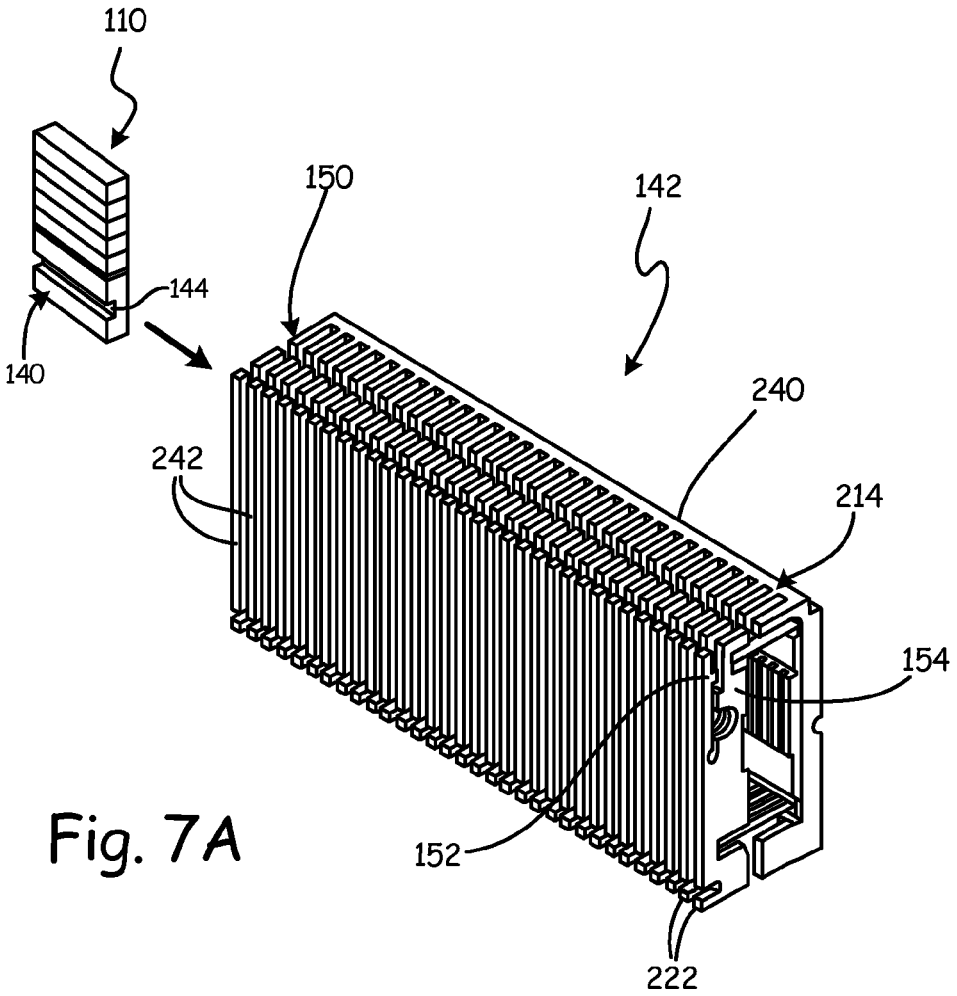
FIGS. 7A-7B illustrate a bending insert for the lapping carrier holder structure illustrated in FIGS. 6A-6B.
Figure 7B:
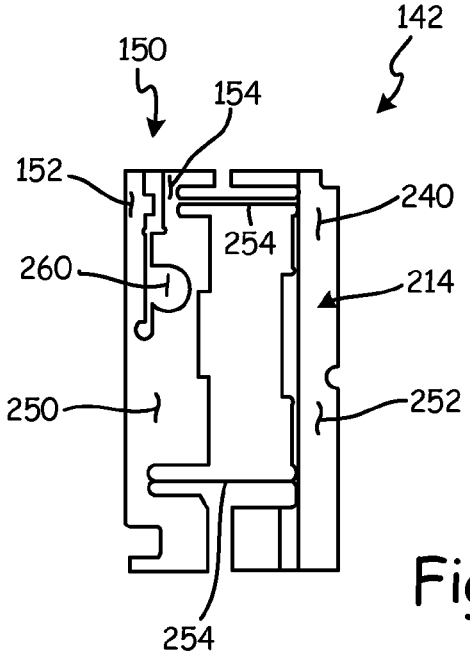

As shown, the lapping machine includes a plurality of bending actuators 220 (schematically shown) to impart a force or bending input to the bending fingers 222 on the bending insert 214. As shown in more detail in FIGS. 7A-7B, the bending insert 214 includes slot 150 between upright holder portions 152, 154 of the insert 214. As previously described, the extender 140 is inserted into the slot 150 to support the bars 112 for lapping against the abrasive lapping surface. As shown, the bending insert 214 includes an insert block 240 having a plurality of bending tines 242 to allow the insert 214 to flex to impart bending to the bar stack 110 through the extender 140. Force is imparted to the bending tines 242 through the fingers 222 spaced along a width of block 240. As previously described, the bending actuators 220 are coupled to the fingers 222 to impart bending to the block 240 through tines 242.

Figure 7C:
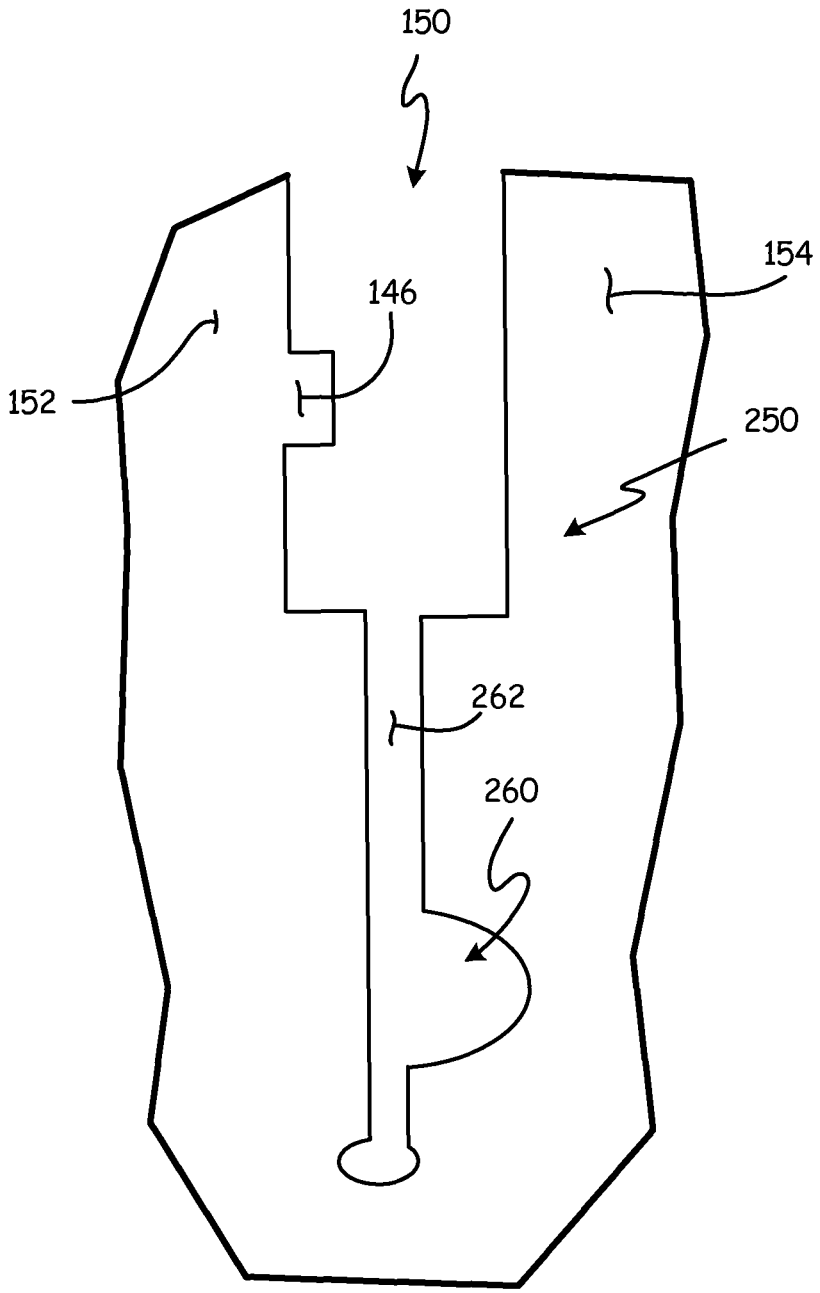
FIG. 7C illustrates an extender slot formed between upright holder portions of the bending insert illustrated in FIGS. 7A-7B.

In the illustrated embodiment, the insert 214 includes a front section 250 and back section 252 connected through flexible plates 254. As shown, the slot 150 for the extender 140 is formed in the front section 250 between upright holder portions 152, 154. As shown in more detail in FIG. 7C, the tongue 146 is formed in slot 150 along a backside of upright holder portion 152 to interface with groove 144 along the extender 140. The front section 250 also includes a channel 260 opened to slot 150 through gap 262 separating the upright holder portions 152, 154. A camming device 265 shown in more detail in FIGS. 8A-8B rotates in channel 260 to bias the upright holder portions 152, 154 outwardly to open the slot 150 to insert the extender 140 to secure the bar stack 110 to the carrier device or holder structure 142. While the slot 150 is open, the extender 140 is inserted by sliding the extender 140 into and along the slot 150 to position the extender 140 in the slot 150 before releasing the camming device 265 to close the slot 150.

Figure 8A:
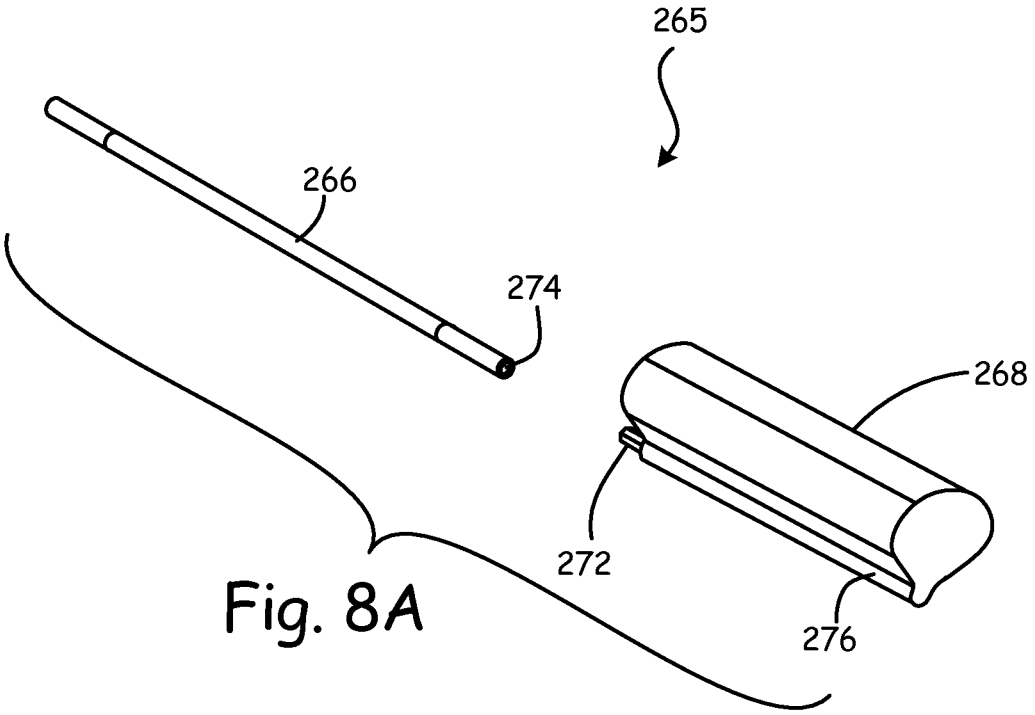
FIGS. 8A-8B illustrate an embodiment of a camming device for opening the extender slot to insert the bar extender and release or close the slot to grip the bar extender for lapping.
Figure 8B:
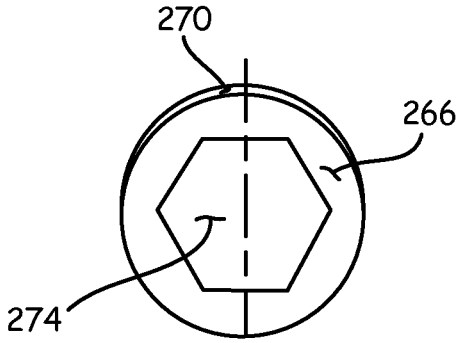

As shown in FIGS. 8A-8B, the camming device 265 includes a rod portion 266 and head portion 268. As shown, the rod portion 266 includes a lobe 270 (shown in FIG. 8B), which provides a camming dimension sized so that when the rod portion 266 is orientated in a crosswise direction in channel 260, the rod portion 266 biases the upright holder portions 152, 154 outwardly to open the slot 150. The lobe 270 is orientated lengthwise direction to close the slot 150. The head portion 268 of the camming device 265 includes a hex extension 272, which extends into a hex socket 274 on the rod portion 266. The head portion 268 includes a detent rail 276, which engages a lip 278 (shown in FIG. 6B) of the carrier base 212 to lock the rod 266 or camming device 265 in the crosswise position so that the slot 150 remains closed to hold the extender 140 and bar stack 110 during the lapping or other operation.

In the embodiment shown in FIGS. 8A-8B, the camming device 265 is rotated by an operator. In an alternate embodiment, the camming device 265 is operated through a mechanized device or includes mechanized components for opening and closing the slot 150 to secure the extender 140 and bar stack 110 to the holder structure 142 of the processing machine or tool.

Figure 9A:
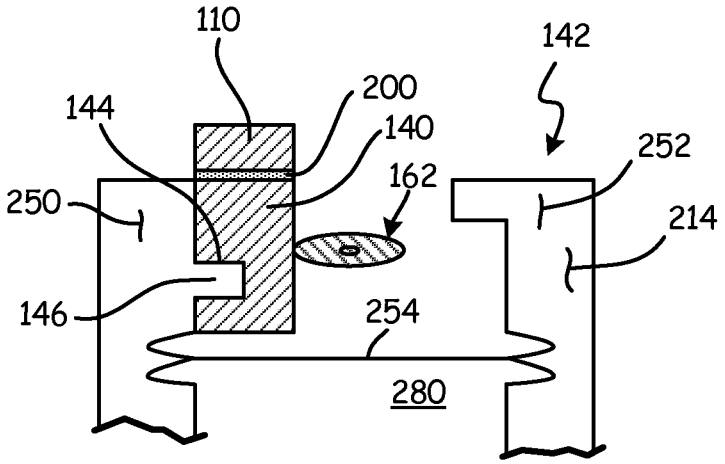
FIGS. 9A-9B illustrate an embodiment of the bending insert of the lapping carrier holder structure including a tongue and groove connection and clamping mechanism to secure the extender to the bending insert for lapping.
Figure 9B:
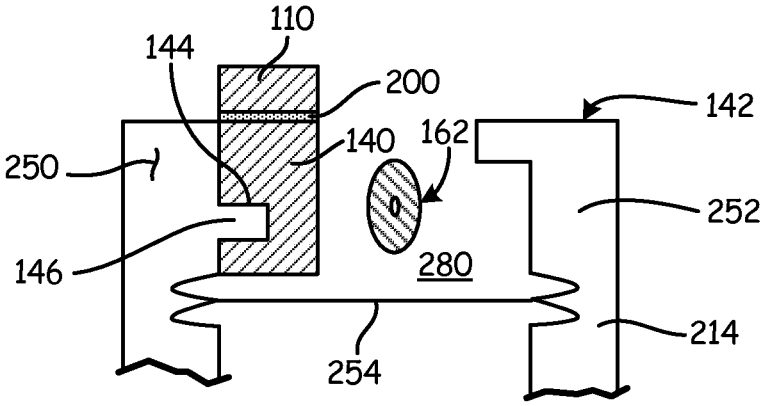
Figure 10A:
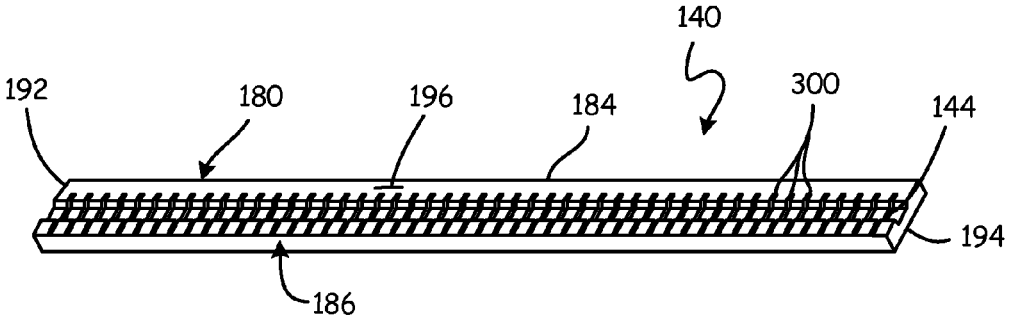
FIGS. 10A-10C illustrate one embodiment of a bar extender including a plurality of reduced thickness strips or portions, where
Figure 10B:
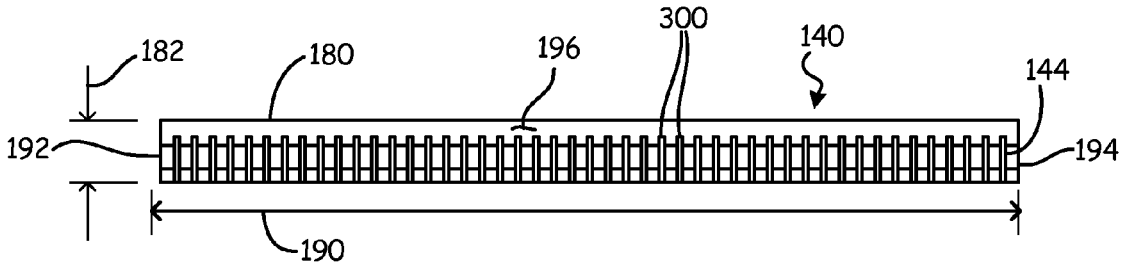
Figure 10C:
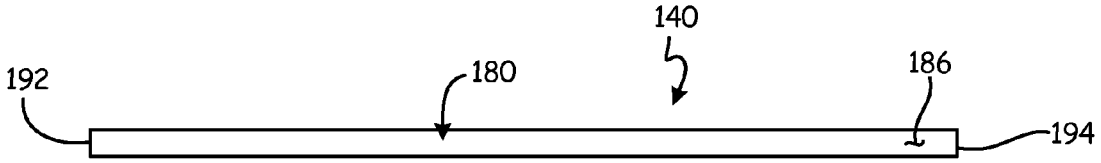
Figure 11A:
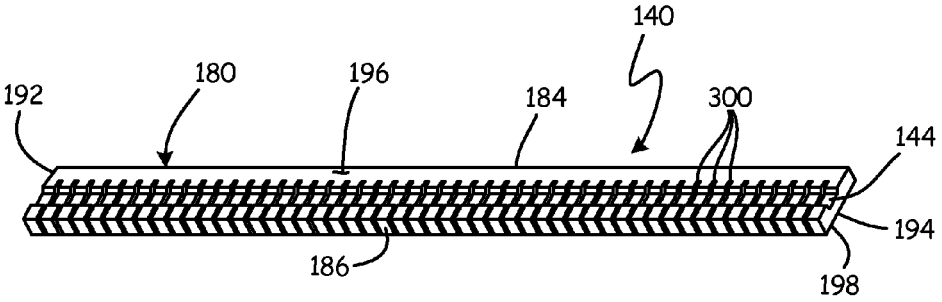
FIGS. 11A-11C illustrate another embodiment of a bar extender including a plurality of reduced thickness strips or portions, where
Figure 11B:
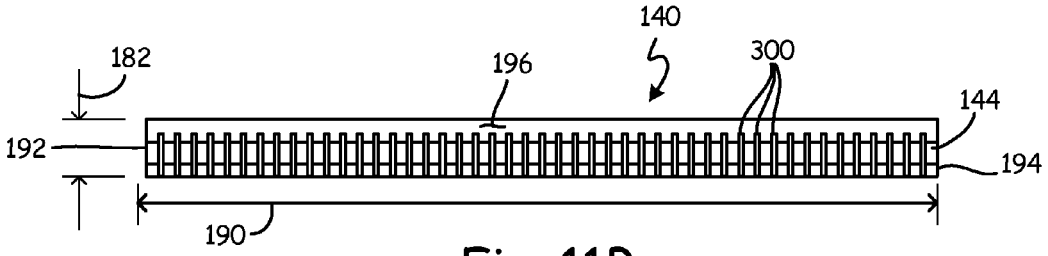
Figure 11C:
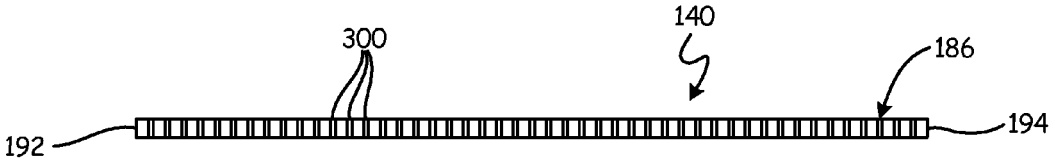

FIGS. 9A-9B illustrates an alternate embodiment of the bending insert 214 for the modular carrier device 210. As shown, the insert 214 include tongue 146 formed on the upright holder portion on a backside of the front segment 250. As shown, clamping device 162 is supported in a gap region 280 between the front and back segments 250, 252 of the bending insert 214. As shown, the extender 140 inserts into the gap region 280 between the front and back segments 250, 252 and is clamped to the upright holder portion on the back side of the front segment 250 via clamping mechanism 162. As comparatively illustrated in FIGS. 9A-9B, the clamping mechanism 162 includes a cam element rotatable between a clamped position and an unclamped position. In particular, as shown, the elongate dimension of the cam element is orientated crosswise to clamp the extender 140 to the upright holder portion or front segment 250 and lengthwise to insert and remove the extender 140. Although the holder structure 142 illustrated in FIGS. 6A-6B and FIGS. 7A-7B is a modular carrier device having a separate bending insert 214 and carrier base 212, application is not limited to the modular construction and additional embodiments of the carrier device include a unitary structure having an integral carrier body and bending portion.

FIGS. 10A-10C and FIGS. 11A-11C illustrate embodiments of the extender 140 where like numbers are used to refer to like parts in the previous FIGS. In the embodiment shown, the extender 140 includes a plurality of reduce thickness strips 300 orientated lengthwise and the groove 144 extends crosswise. The reduced thickness strips 300 are spaced between the opposed end surfaces 192, 194 to transmit the bending profile from the bending insert 214 to the slider bar stack 110. The reduced thickness strips 300 are formed of shallow trenches cut along the front surface 196 of the extender 140. In the embodiment shown in FIGS. 10A-10B, the reduced thickness strips 300 extend along the front surface 196 and in the embodiment shown in FIGS. 11A-11C, the shallow trenches of the reduced thickness strips 300 have a length that extends from above the groove 144 below the groove 144 and along the distal edge surface 186 of the extender 140.

Figure 12:
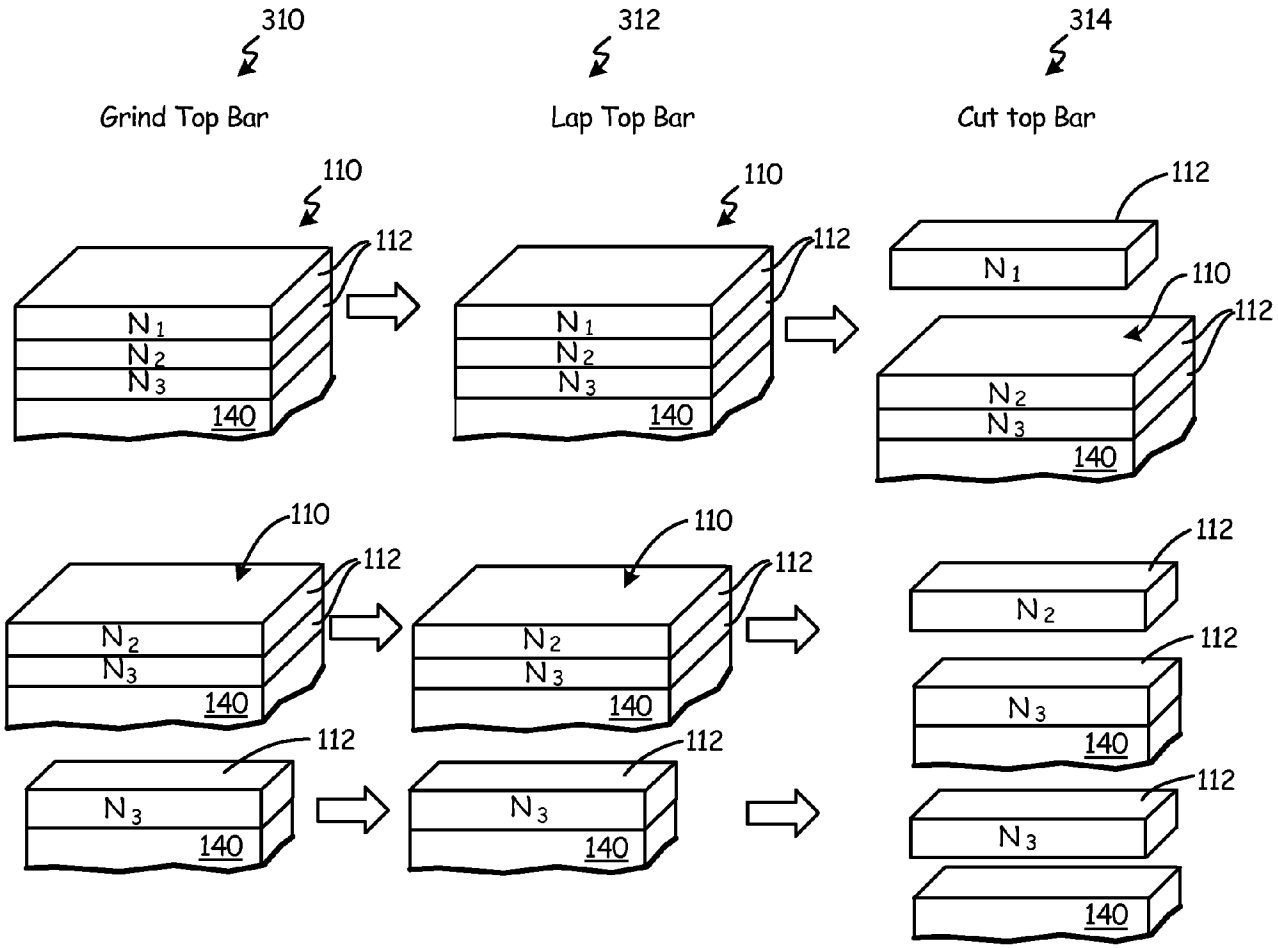
FIG. 12 illustrates a processing sequence for slider bars in which embodiments of the present application are used.

The tongue and groove connection shown in the previous FIGS. has application for connecting the slider bar stack 110 to different grinding and lapping machines for grinding, lapping and slicing bars. FIG. 12 illustrates a process sequence for bars $N_1$-$N_3$ in a bar stack 110. As shown in FIG. 12, the top bar $N_1$ 112 of the stack 110 is sequentially ground in step 310, lapped in step 314 and cut from the stack 110 in step 314. In particular, the surface of top bar $N_1$ is ground in step 310 and lapped in step 312. Following the grinding and lapping in steps 310, 312, the top bar $N_1$ is cut from the stack 110 so that bar $N_2$ becomes the top bar. The process of grinding—lapping—cutting of steps 310, 312, 314 is then repeated for top bar $N_2$ so that following step 314 bar $N_3$ is the top bar. The process steps of grinding and lapping 310, 312 the top surface is repeated for top bar $N_3$. The process sequence illustrated in steps 310, 312 and 314 is repeated until each bar in the stack is ground and lapped and then separated from the stack 110. As illustrated in FIG. 12, once the bottom bar $N_3$ is ground and lapped in steps 310, 312, the bar $N_3$ is separated from the extender 140 as shown.

In illustrated embodiments, the bars 112 of the bar stack 110 are ground, lapped and sliced using a grinding/slicing machine and a lapping machine. Thus, to implement the process steps illustrated in FIG. 12, bar stack 110 is mounted on the grinding/slicing machine for the grinding and slicing steps 310, 314 and the lapping machine to implement the lapping step 312. Embodiments of the present application facilitate mounting and demounting of the bar stack 110 to the different processing machines including the grinding/slicing machine and the lapping machine. In particular as described, the bar stack 110 is adhered or connected to the extender 140. The extender 140 is connected to the different processing machines or tools via the tongue and groove connection as described. Thus the extender 140 is connected to the grinding/slicing machine to grind the top bar in step 310. The extender 140 is removed and connected to the lapping carrier or device to lap the top bar in step 312. Thereafter the extender 140 is connected to the grinding/slicing machine to slice the top bar in step 314 and grind the next bar $N_2$ in step 310.

It is to be understood that even though numerous characteristics and advantages of various embodiments of the invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, the particular elements may vary depending on the particular application while maintaining substantially the same functionality without departing from the scope and spirit of the present invention. In addition, although the preferred embodiment described herein is directed to it will be appreciated by those skilled in the art that the teachings of the present invention can be applied to other lapping or grinding applications without departing from the scope and spirit of the present invention.

What is claimed is:

1. An assembly comprising:

a slider bar extender including a front surface and a back surface, a crosswise dimension between opposed end surfaces and a lengthwise dimension between a proximal edge surface and a distal edge surface;

an elongate groove extending crosswise on the front surface of the extender to removably connect one or more slider bars to one or more processing machines or tools through the extender; and a holder structure including a holder portion having an elongate tongue configured to insert into the groove on the extender to secure the extender to the holder structure, wherein the holder structure comprises a bending insert including the elongate tongue and having a plurality of bending tines configured to impart bending to the one or more slider bars through the extender, and wherein the slider bar extender comprises at least one bending profile transmission feature.

2. The assembly of claim 1 comprising:

an adhesive layer connecting the one or more slider bars to the proximal edge surface of the extender.

3. The assembly of claim 1 wherein a length of the groove extends between the opposed end surfaces of the extender and the groove includes open ends at the opposed end surfaces of the extender.

4. The assembly of claim 1 wherein the at least one bending profile transmission feature includes a plurality of reduced thickness strips extending lengthwise.

5. The assembly of claim 4 wherein the plurality of reduced thickness strips are spaced between the opposed end surfaces of the extender.

6. The assembly of claim 4 wherein a portion of the reduced thickness strips forms a bottom of the groove.

7. The assembly of claim 1 wherein the holder structure includes a clamping mechanism configured to clamp the extender relative to the holder portion of the holder structure to secure the extender to the holder structure.

8. The assembly of claim 1 wherein the holder structure includes first and second upright holder portions spaced to form a slot between the first and second upright holder portions and the tongue is formed on one of the first and second upright holder portions, and wherein the first and second upright holder portions are a part of the bending insert, and wherein the bending insert is supported in a carrier base of the holder structure.

9. The assembly of claim 8 and comprising a camming device configured to separate the first and second upright holder portions to insert the expander into the slot and close the first and second upright portion to engage the tongue in the groove of the extender to secure the extender to the holder structure.

10. The assembly of claim 9 wherein the camming device includes a camming rod insertable into a channel of the holder structure open to the slot through a gap connecting the channel to the slot and the camming rod includes a lobe having a first orientation to separate the upright holder portions to open the slot to insert the extender and a second orientation to release the upright holder portions to grip the extender in the slot between the upright holder portions of the holder structure.

* * * * *